US010278469B2

(12) United States Patent
Feng

(10) Patent No.: US 10,278,469 B2
(45) Date of Patent: May 7, 2019

(54) HAIRDRESSING APPARATUS WITH ANION FUNCTION HAVING SWITCH, TEMPERATURE REGULATION AND DISPLAY PARTS

(71) Applicant: Shenzhen Lady Merry Technology Co., Ltd, Shenzhen (CN)

(72) Inventor: Ye Feng, Shenzhen (CN)

(73) Assignee: SHENZHEN LADY MERRY TECHNOLOGY CO., LTD., Shenzhen (CN)

( * ) Notice: Subject to any disclaimer, the term of this patent is extended or adjusted under 35 U.S.C. 154(b) by 377 days.

(21) Appl. No.: 15/142,536

(22) Filed: Apr. 29, 2016

(65) Prior Publication Data

US 2017/0311690 A1 Nov. 2, 2017

(51) Int. Cl.
*A45D 2/00* (2006.01)
*A45D 1/28* (2006.01)
*A45D 1/06* (2006.01)

(52) U.S. Cl.
CPC ..... *A45D 2/001* (2013.01); *A45D 1/06* (2013.01); *A45D 1/28* (2013.01); *A45D 2200/202* (2013.01)

(58) Field of Classification Search
CPC ... A45D 1/04; A45D 1/06; A45D 1/28; A45D 2/00; A45D 2/001; A45D 2/002; A45D 2001/004; A45D 2001/006; A45D 7/00; H05B 3/267
USPC ..... 132/269
See application file for complete search history.

(56) References Cited

U.S. PATENT DOCUMENTS

2008/0110871 A1* 5/2008 Wu ..... A45D 1/04 219/222
2009/0159093 A1* 6/2009 Yu ..... A45D 1/04 132/211
2010/0078038 A1* 4/2010 Shami ..... A45D 1/08 132/224
2010/0089413 A1* 4/2010 Wright ..... A45D 2/001 132/211
2010/0206322 A1* 8/2010 Mukai ..... A45D 1/04 132/269
2011/0174331 A1* 7/2011 Kim ..... A45D 1/04 132/229
2011/0247647 A1* 10/2011 Kim ..... A45D 1/04 132/269

(Continued)

*Primary Examiner* — Tatiana L Nobrega
*Assistant Examiner* — Jennifer F Gill
(74) *Attorney, Agent, or Firm* — Scheiser, Olsen & Watts LLP

(57) ABSTRACT

Disclosed is a hairdressing apparatus with an anion generator, the apparatus having a switch, a temperature regulator, and display parts. An upper body and a lower body are fixedly connected through a hinge. An anion generator fixed holder, a first support, an anion generator hood, a first elastic piece, a first aluminum plate with a first metal ceramic heater arranged in it, and a lower cover plate arranged in the lower body. A second support, a printed circuit board assembly plate, an anion generator, a second elastic piece, a second aluminum plate with a second metal ceramic heater arranged in it, and an upper cover plate are arranged in the upper body. An integrated structure is applied to this hairdressing apparatus, insuring safety and comfort to whoever uses it.

2 Claims, 8 Drawing Sheets

(56) References Cited

U.S. PATENT DOCUMENTS

| | | | | |
|---|---|---|---|---|
| 2012/0312319 | A1* | 12/2012 | Uwano | A45D 2/001 132/211 |
| 2013/0098389 | A1* | 4/2013 | Uwano | A45D 1/04 132/269 |
| 2015/0296950 | A1* | 10/2015 | Everett, Jr. | A45D 1/04 219/225 |
| 2016/0360846 | A1* | 12/2016 | Shami | A45D 1/04 |

* cited by examiner

HAIRDRESSING APPARATUS WITH ANION FUNCTION HAVING SWITCH, TEMPERATURE REGULATION AND DISPLAY PARTS

FIELD OF THE UTILITY MODEL

The utility model relates to a hairdressing apparatus with an anion function having switch, temperature regulation and display parts, belonging to the technical field of hairdressing devices.

BACKGROUND OF THE UTILITY MODEL

A hairdressing apparatus in hairdressing industry has a power switch part, a temperature regulation part and a display part which are separately designed, and does not have an anion function. In this industry, there are very few products with a power switch part, a temperature regulation part and a display part being designed integrally, so the use demand of people cannot be met.

SUMMARY OF THE UTILITY MODEL

In view of the above problems, the utility model aims to solve the technical problem of providing a hairdressing apparatus with an anion function having switch, temperature regulation and display parts.

The utility model discloses a hairdressing apparatus with an anion function having switch, temperature regulation and display parts, which comprises a lower body, an anion fixed holder, a first support, an anion hood, a first elastic piece, a first metal ceramic heater(MCH), a first aluminum plate, a lower plate, an upper body, a second support, a printed circuit board assembly(PCBA) plate, an anion generator, a second elastic piece, a second MCH, a second aluminum plate, an upper cover plate, a spring, a shaft sleeve, a shaft sleeve screw, a side cover, a line pressing cover, a power line and a receptacle, wherein the anion fixed holder and the first support are arranged in the lower body, the anion is arranged on the anion fixed holder, the anion hood is arranged over the anion, the first MCH is arranged in the first aluminum plate, the upper part of the first MCH is fixed on the first aluminum plate through the first elastic piece, and then the first support is fixed on the first aluminum plate, to form a first heating unit component, the first heating unit component is arranged in the lower body, the anion hood is fixed on the lower cover plate, the lower cover plate is fixed on the upper part of the lower body through a screw, the power line is connected and placed in a slot of the lower body through the receptacle and is fixed at the tail of the lower body by the line pressing cover, the second support and the PCBA plate are arranged in the upper body, the second MCH is arranged in the second aluminum plate, a fuse is arranged on the second MCH and is fixed on the second aluminum plate through the second elastic piece, and then the second support is fixed on the second aluminum plate to form a second heating unit component, the second heating unit component is arranged in the upper body, the upper cover plate is fixed on the upper part of the upper body through a screw, the spring is arranged between the upper cover plate and the lower cover plate, and the upper body is fixedly connected with the lower body through the shaft sleeve and the shaft sleeve screw, which are further sleeved with the side cover on the outer side.

Preferably, a mounting pore is arranged on the upper body, a rotary knob is arranged in the mounting pore, a gear is arranged on one side of the rotary knob, the lower part of the rotary knob and the gear are engaged with each other, and a lens, or window is arranged on the upper surface of the rotary knob.

The utility model has the beneficial effects that the hairdressing apparatus is reasonable in structure design, beautiful in appearance, novel and unique in style, easy to mount and convenient to use; with a power switch part, a temperature regulation part and a display part designed to be an integral structure, the hairdressing apparatus not only has an anion function, but also is safe and comfortable, so that the use demands of different people are met.

BRIEF DESCRIPTION OF THE DRAWINGS

For the sake of convenient illustration, the utility model is described in detail with reference to the following specific embodiments and accompanying drawings.

1. lower body; 2. anion fixed holder; 3. first support; 4. anion hood; 5. first elastic piece; 6. first MCH; 7. first aluminum plate; 8. lower plate; 9. upper body; 9-1. mounting pore; 9-2. rotary knob; 9-3. gear; 9-4. lens; 10. second support; 11. PCBA plate; 12. anion generator; 13. second elastic piece; 14. second MCH; 15. second aluminum plate; 16. upper cover plate; 17. spring; 18. shaft sleeve; 19. shaft sleeve screw; 20. side cover; 21. line pressing cover; 22. power line; and 23. receptacle.

DETAILED DESCRIPTION OF THE EMBODIMENTS

Figure 1:
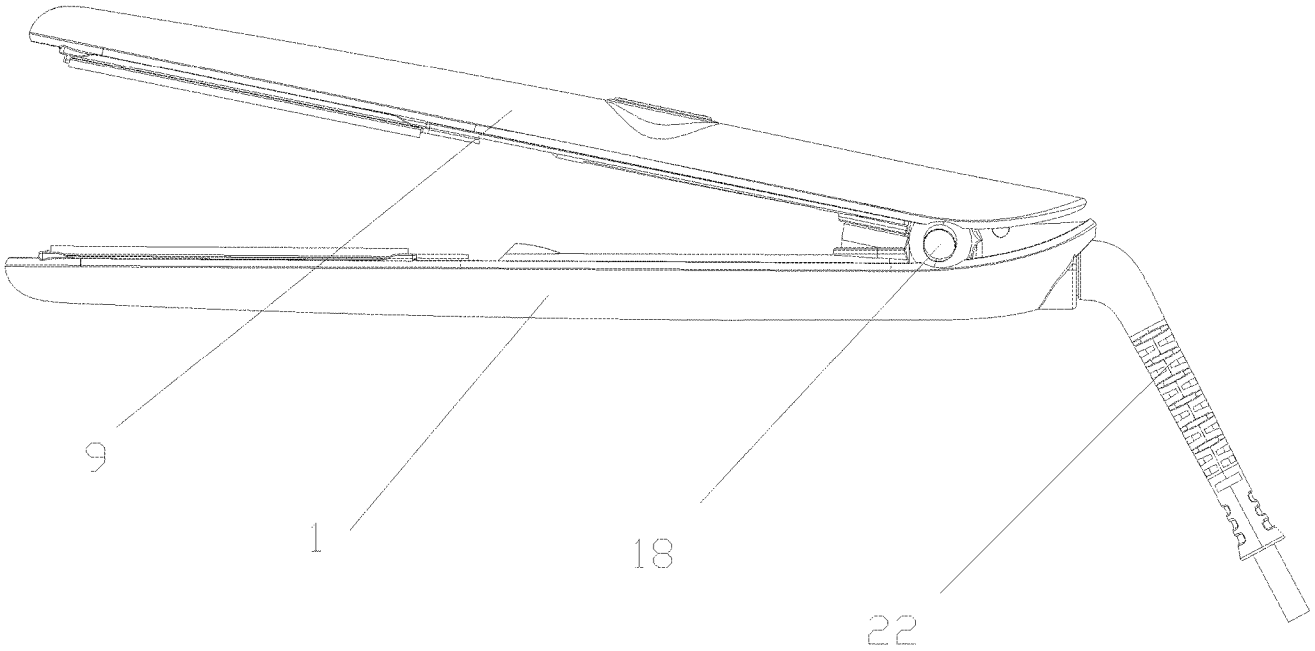
FIG. 1 is a schematic view of a structure of the utility model.
Figure 2:
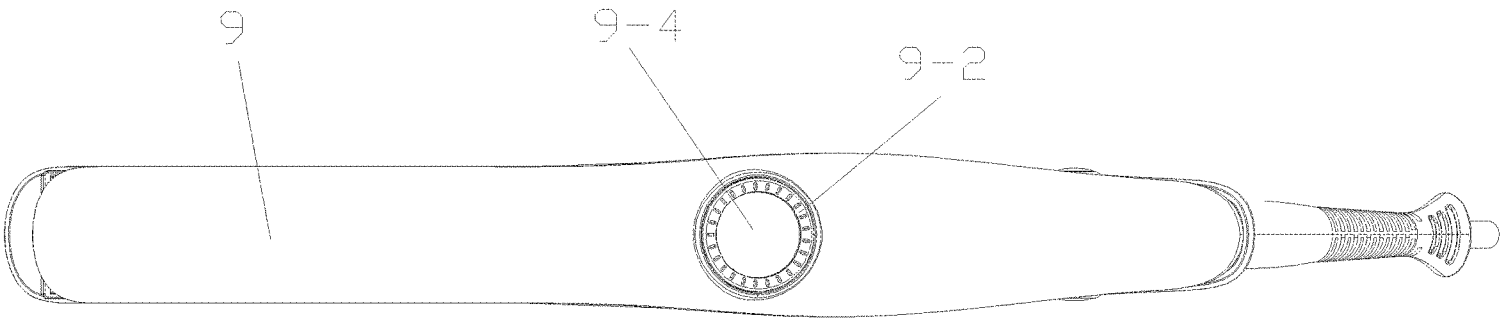
FIG. 2 is a top view of FIG. 1.
Figure 3:
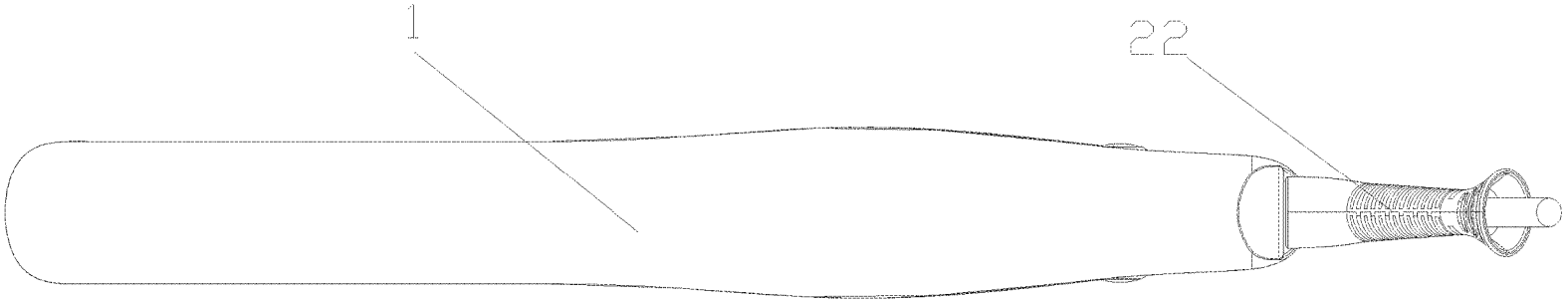
FIG. 3 is a bottom view of FIG. 1.
Figure 4:
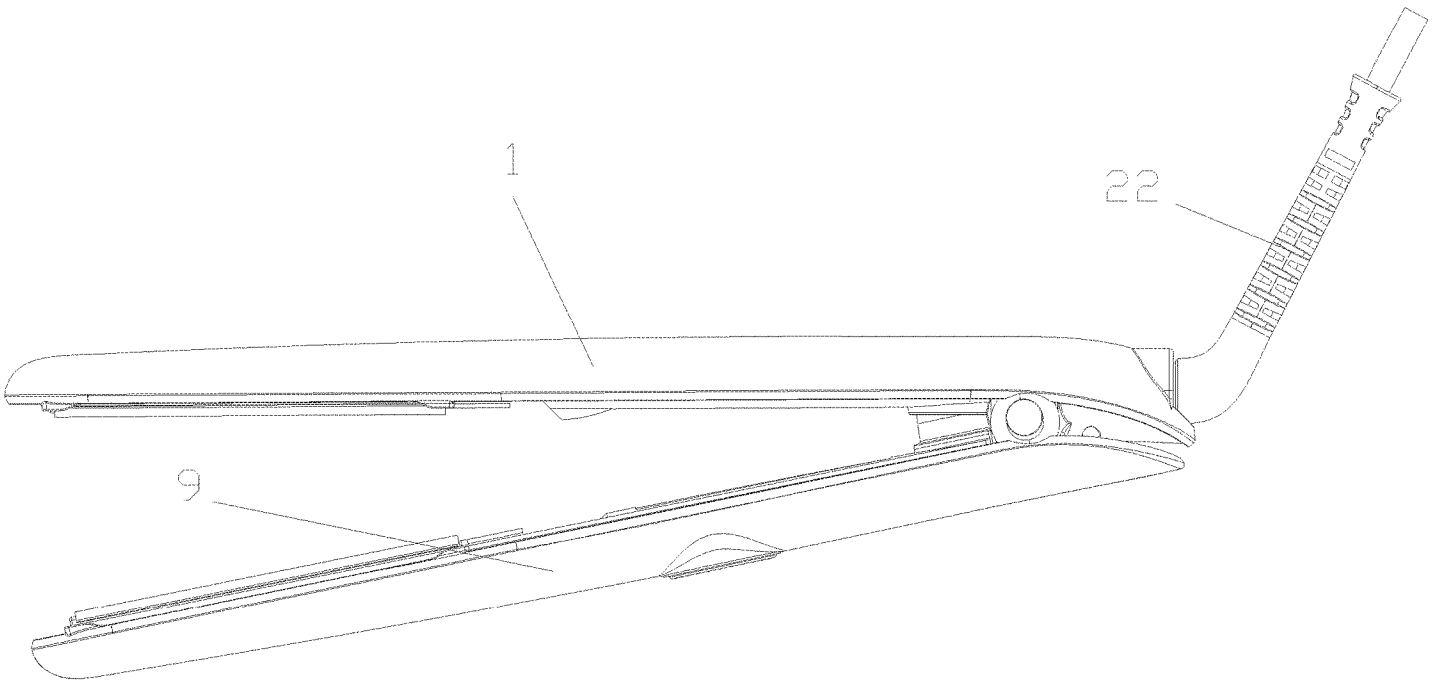
FIG. 4 is a schematic view of a structure of the utility model after rotation.
Figure 5:
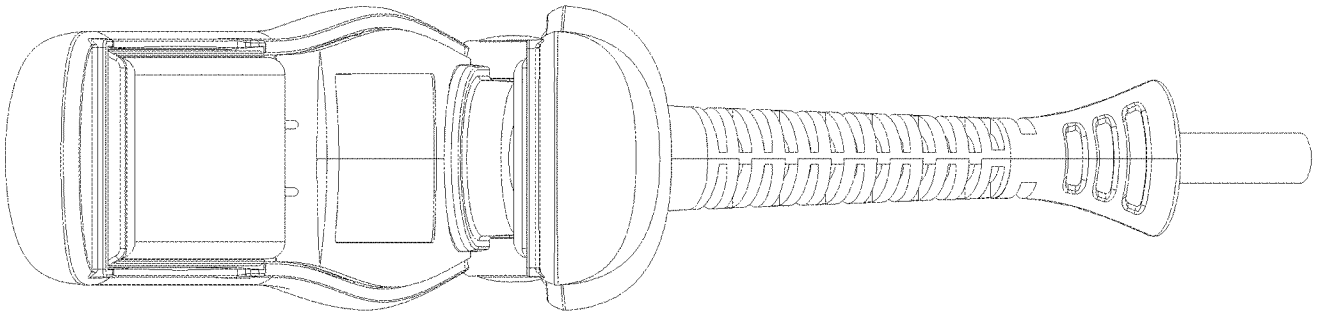
FIG. 5 is a left view of FIG. 1.
Figure 6:
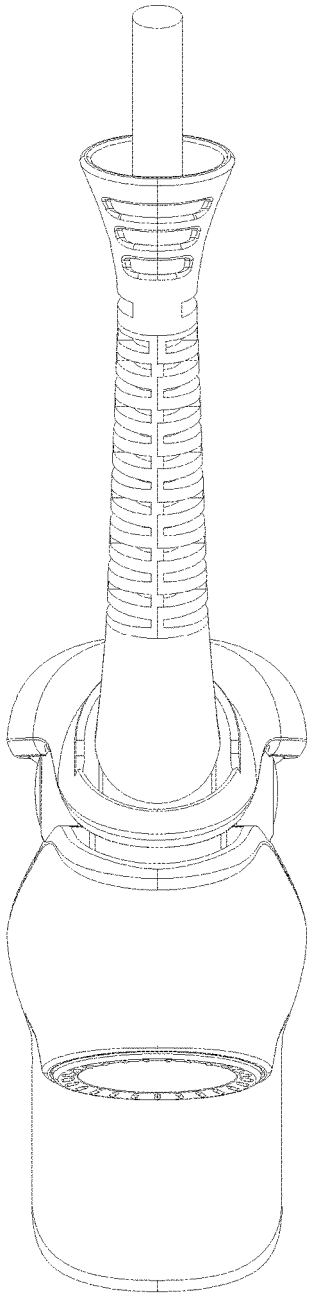
FIG. 6 is a right view of FIG. 1.
Figure 7:
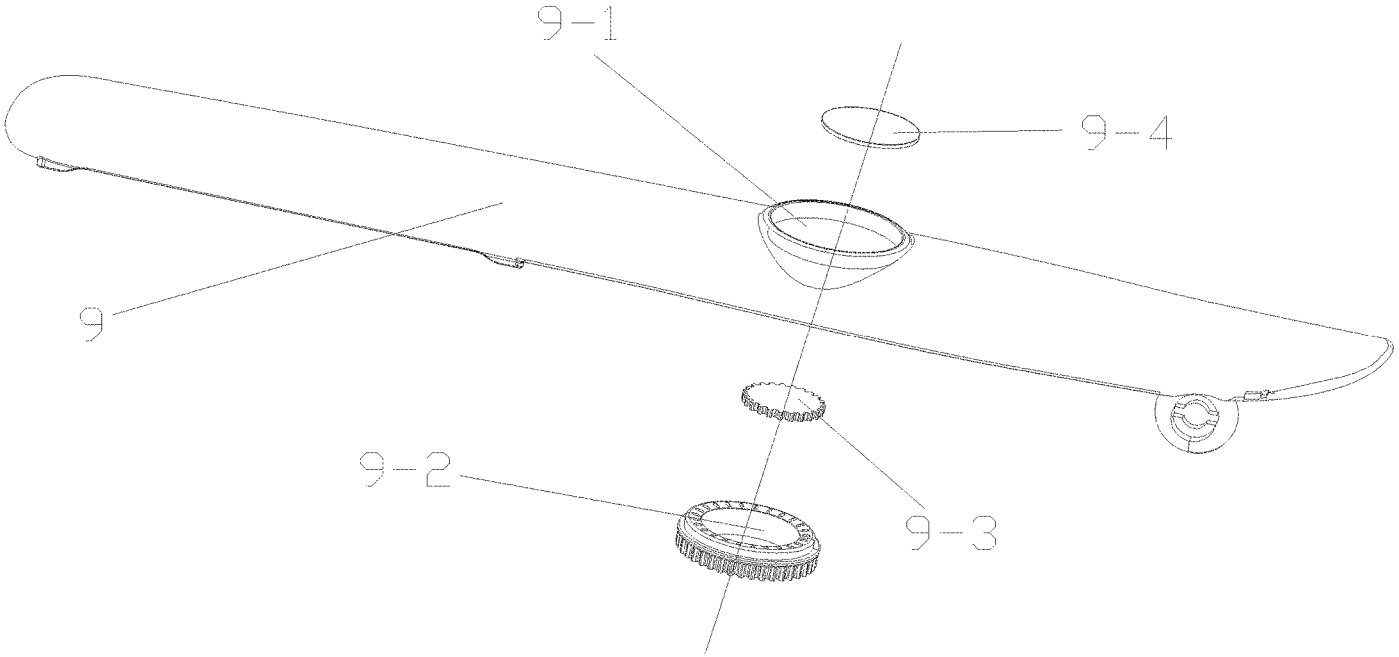
FIG. 7 is a schematic view of a mounting structure of a display part of an upper body in the utility model.
Figure 8:
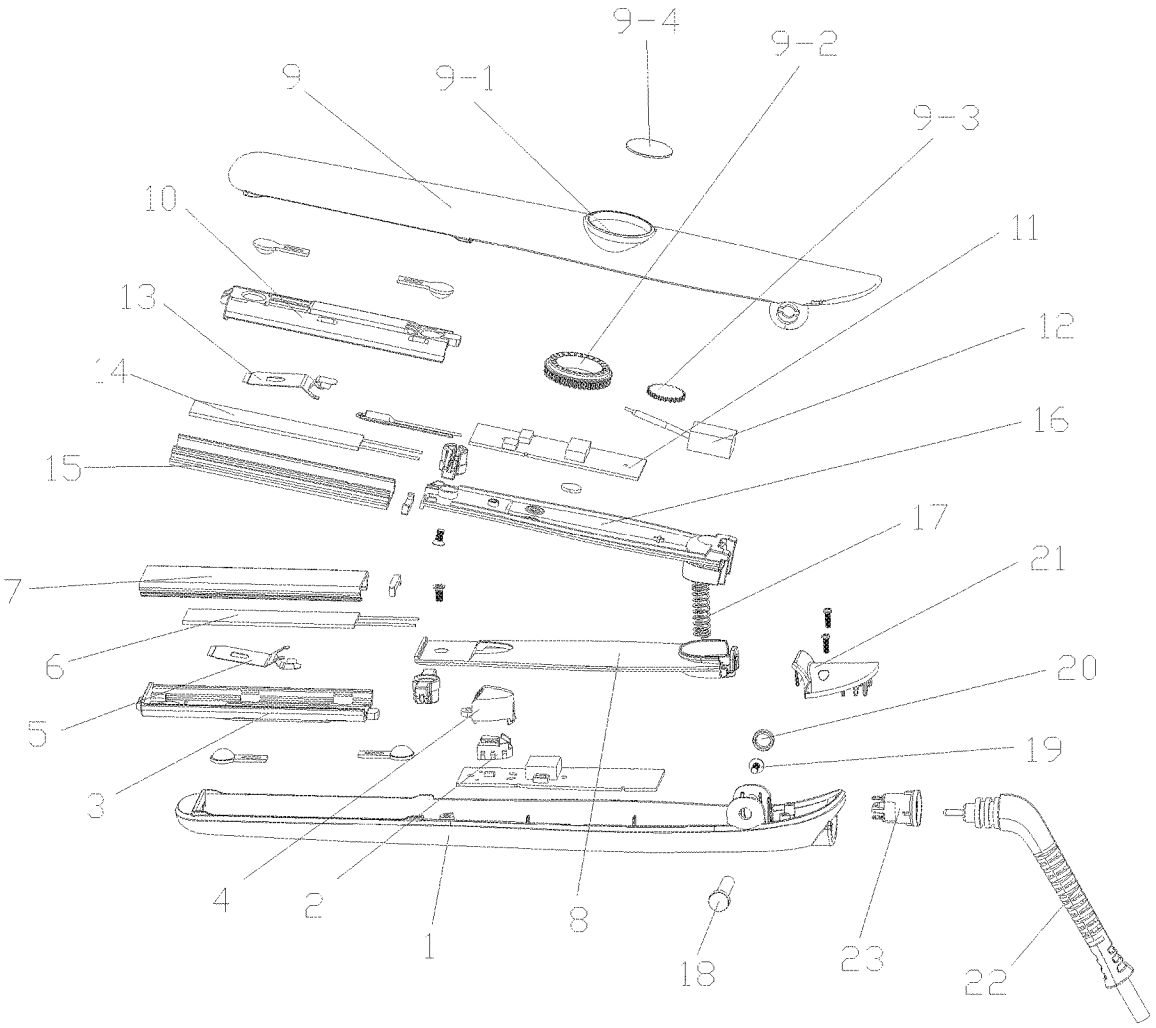
FIG. 8 is a schematic view of an exploded structure of the utility model.

As shown in FIGS. 1-8, the specific embodiment employs the following technical solution: the hairdressing apparatus comprises a lower body 1, an anion fixed holder 2, a first support 3, an anion hood 4, a first elastic piece 5, a first MCH 6, a first aluminum plate 7, a lower plate 8, an upper body 9, a second support 10, a PCBA plate 11, an anion 12, a second elastic piece 13, a second MCH 14, a second aluminum plate 15, an upper cover plate 16, a spring 17, a shaft sleeve 18, a shaft sleeve screw 19, a side cover 20, a line pressing cover 21, a power line 22 and a receptacle 23, wherein the anion fixed holder 2 and the first support 3 are arranged in the lower body 1, the anion 12 is arranged on the anion fixed holder 2, the anion hood 4 is arranged over the anion 12, the first MCH 6 is arranged in the first aluminum plate 7, the upper part of the first MCH 6 is fixed on the first aluminum plate 7 through the first elastic piece 5, and then the first support 3 is fixed on the first aluminum plate 7 to form a first heating unit component, the first heating unit component is arranged in the lower body 1, the anion hood 4 is fixed on the lower cover plate 8, the lower cover plate 8 is fixed on the upper part of the lower body 1 through a screw, the power line 22 is connected and placed in a slot of the lower body 1 through the receptacle 23 and is fixed at the tail of the lower body 1 by the line pressing cover 21, the second support 10 and the PCBA plate 11 are arranged in the upper body 9, the second MCH 14 is arranged in the second aluminum plate 15, a fuse is arranged on the second MCH 14 and is fixed on the second aluminum plate 15 through the second elastic piece 13, and then the second support 10 is fixed on the second aluminum plate 15, to form a second heating unit component, the second heating unit component is arranged in the upper body 9, the upper cover plate 16 is fixed on the upper part of the upper body 9 through a screw, the spring 17 is arranged between the upper cover plate 16 and the lower cover plate 8, and the upper body 9 is fixedly connected with the lower body 1 through the shaft sleeve 18 and the shaft sleeve screw 19, which are further sleeved with the side cover 20 on the outer side.

A mounting pore 9-1 is arranged on the upper body 9, a rotary knob 9-2 is arranged in the mounting pore 9-1, a gear 9-3 is arranged on one side of the rotary knob 9-2, the lower part of the rotary knob 9-2 and the gear 9-3 are engaged with each other, and a lens 9-4 is arranged on the upper surface of the rotary knob 9-2.

According to this specific embodiment, the hairdressing apparatus can also be normally used in the case of no anion, not only is the manufacturing simple, but also the manufacturing cost can be reduced, and the applicable range is wider.

The hairdressing apparatus in the specific embodiment is reasonable structure design, beautiful in appearance, novel and unique in style, easy to mount and convenient to use. With a power switch part, a temperature regulation part and a display part designed to be an integral structure, the hairdressing apparatus not only has an anion function, but also is safe and comfortable, so that the use demands of different people are met.

The basic principle, main features and advantages of the utility model are shown and described above. It should be understood by a person skilled in the art that the utility model is not limited to the above embodiment. The aforementioned embodiment and description in the specification only illustrate the principle of the utility model. Various variations and improvements can be made to the utility model without departing from the spirit and scope of the utility model, and all these variations and improvements fall into the scope claimed by the utility model. The protection scope claimed by the utility model is defined by the appended claims and equivalents thereof.

The invention claimed is:

1. A hairdressing apparatus with having an anion generator, a temperature regulator, and a temperature display wherein the hairdressing apparatus comprises: a lower body (1), an anion generator fixed holder (2), a first support (3), an anion generator hood (4), a first elastic piece (5), a first metal ceramic heater (6), a first aluminum plate (7), a lower cover plate (8), an upper body (9), a second support (10), a printed circuit board assembly plate (11), the anion generator (12), a second elastic piece (13), a second metal ceramic heater (14), a second aluminum plate (15), an upper cover plate (16), a spring (17), a shaft sleeve (18), a shaft sleeve screw (19), a side cover (20), a line pressing cover (21), a power line (22) and a receptacle (23), wherein the anion generator fixed holder (2) and the first support (3) are arranged in the lower body (1), the anion generator (12) is arranged on the anion generator fixed holder (2), the anion generator hood (4) is arranged over the anion generator (12), the first metal ceramic heater (6) is arranged in the first aluminum plate (7), an upper part of the first metal ceramic heater (6) is fixed on the first aluminum plate (7) through the first elastic piece (5), and wherein the first support (3) is fixed on the first aluminum plate (7), to form a first heating unit component, the first heating unit component is arranged in the lower body (1), the anion generator hood (4) is fixed on the lower cover plate (8), the lower cover plate (8) is fixed on an upper part of the lower body (1) through a screw, the power line (22) is connected to the lower body by being placed in a slot of the lower body (1) through the receptacle (23) and the power line being fixed at a tail end of the lower body (1) by the line pressing cover (21), the second support (10) and the printed circuit board assembly plate (11) are arranged in the upper body (9), the second metal ceramic heater (14) is arranged in the second aluminum plate (15), a fuse is arranged on the second metal ceramic heater (14) and is fixed on the second aluminum plate (15) through the second elastic piece (13), and the second support (10) is fixed on the second aluminum plate (15) to form a second heating unit component, the second heating unit component is arranged in the upper body (9), the upper cover plate (16) is fixed on an upper part of the upper body (9) through a screw, the spring (17) is arranged between the upper cover plate (16) and the lower cover plate (8), and the upper body (9) is fixedly connected with the lower body (1) through the shaft sleeve (18) and the shaft sleeve screw (19), which are further sleeved with the side cover (20) on an outer side of the apparatus.

2. The hairdressing apparatus of claim 1 further comprising a mounting pore (9-1) arranged on the upper body (9), a rotary knob (9-2) arranged in the mounting pore (9-1), a gear (9-3) arranged on one side of the rotary knob (9-2), a lower part of the rotary knob (9-2) and the gear (9-3) are engaged with each other, and a window (9-4) arranged on an upper surface of the rotary knob (9-2).

* * * * *